United States Patent [19]

Labelle

[11] 4,357,981

[45] Nov. 9, 1982

[54] PANIC BAR ASSEMBLY

[76] Inventor: Henri M. R. Labelle, 50 Westmooreland Ave., Cornwall, Ontario, Canada

[21] Appl. No.: 127,637

[22] Filed: Mar. 6, 1980

[51] Int. Cl.[3] ..... E05D 15/58; E06B 11/06

[52] U.S. Cl. ..... 160/183; 292/92

[58] Field of Search ..... 160/180, 183, 154, 155, 160/199, 200, 206, 186, 84 R; 49/169, 170, 171; 292/DIG. 30, 92–93; 70/92

[56] References Cited

U.S. PATENT DOCUMENTS

| | | | |
|---|---|---|---|
| 1,213,105 | 1/1917 | Hurd | 70/92 |
| 1,441,336 | 1/1923 | Flowers | 70/92 |
| 1,524,006 | 1/1925 | Dodge | 160/206 |
| 1,874,820 | 8/1932 | Simone | 160/180 X |
| 2,350,305 | 5/1944 | Lapina | 160/84 R |
| 3,073,142 | 1/1963 | Stebbins | 292/92 X |
| 3,458,225 | 7/1969 | Brothers et al. | 70/92 |

*Primary Examiner*—Price C. Faw, Jr.
*Assistant Examiner*—Cherney S. Lieberman
*Attorney, Agent, or Firm*—Charles E. Brown

[57] ABSTRACT

A panic bar assembly for use with a folding door. The panic bar assembly has a panic bar moveable between an operative, horizontal position, with the door unfolded, and an inoperative diagonal position with the door folded. The panic bar moves between its operative horizontal position and its inoperative, diagonal position simultaneously with the folding and unfolding of the door.

10 Claims, 11 Drawing Figures

PANIC BAR ASSEMBLY

BACKGROUND OF THE INVENTION

1. Field of the Invention

This invention is directed toward a panic bar assembly.

The invention is more particularly directed toward a panic bar assembly for use on a folding door.

The invention is also directed toward a folding door incorporating the panic bar assembly.

2. Description of the Prior Art

Panic bar assemblies for non-folding doors, particularly non-folding, emergency exit doors, are well known. The assemblies generally include a rigid panic bar which extends horizontally across the back of the door, generally at waist level. The bar is spaced several inches away from the back of the door, and is movably mounted at its ends to fixed mounting members, one located at each side of the door. Within one of the mounting members, the bar is operatively connected to the door latch. When the bar is pushed down and toward the door, relative to the mounting members, it will automatically operate the door latch to open the door. In a panic situation, where people crowd against the door, trying to get out of a room or a building closed by the door, the people at the front of the crowd pushed against the bar, will move it to operate the latch and thus automatically open the door.

Panic bar assemblies are usually installed in non-folding, emergency exit doors in commercial buildings or establishments because of their fool-proof operation. However, many commercial buildings or establishments, particularly those located in enclosed shopping centers or malls, now employ folding closures. The folding closure often unfolds to extend across the entire width of the establishment to close the front of the establishment. To provide an emergency exit from the closed establishment, the folding closure is often provided with a folding emergency door in its structure. This emergency door folds and unfolds along with the remainder of the folding closure. When the door is unfolded, a latch in the door can be operated and the door can be swung out to open an emergency exit in the closure. At the present time, however, no known panic bar assembly can be employed on the emergency exit door since the rigid, fixed, panic bar in the known assembly would prevent the folding of the door during folding of the closure.

SUMMARY OF THE INVENTION

It is therefore the purpose of the present invention to provide a panic bar assembly which can be employed on folding doors. The panic bar assembly of the present invention is constructed so that the bar does not prevent folding of the emergency door, and yet is in the proper operative position when the emergency door is unfolded.

In accordance with the present invention, a panic bar assembly is provided for use with a folding door having a panic bar movable between an operative, horizontal position with the door unfolded, and an inoperative diagonal position with the door folded. The panic bar moves between its operative, horizontal position and its inoperative, diagonal position simultaneously with the folding and unfolding of the door.

In order for the panic bar to be able to move between horizontal and diagonal positions, one of the two mounting members to which the bar is connected, is movably mounted on the door for vertical movement. In addition, the panic bar is provided with two spaced-apart pivot connections in its length allowing the panic bar to move with the movable mounting member when the mounting member is moved.

The invention is particularly directed toward a panic bar assembly for use in a folding door, the assembly having first and second mounting members adapted to be mounted at the sides of a folding door. At least one of the mounting members is mounted for selective movement in a vertical direction on the door. A panic bar is mounted at its ends to the mounting members. A pair of spaced-apart pivot means are provided in the panic bar allowing the panic bar to move with the one mounting member when the one mounting member is moved in a vertical direction on the door.

BRIEF DESCRIPTION OF THE DRAWINGS

The invention will now be described in detail having reference to the accompanying drawings in which.

DESCRIPTION OF THE PREFERRED EMBODIMENTS

Figure 1:
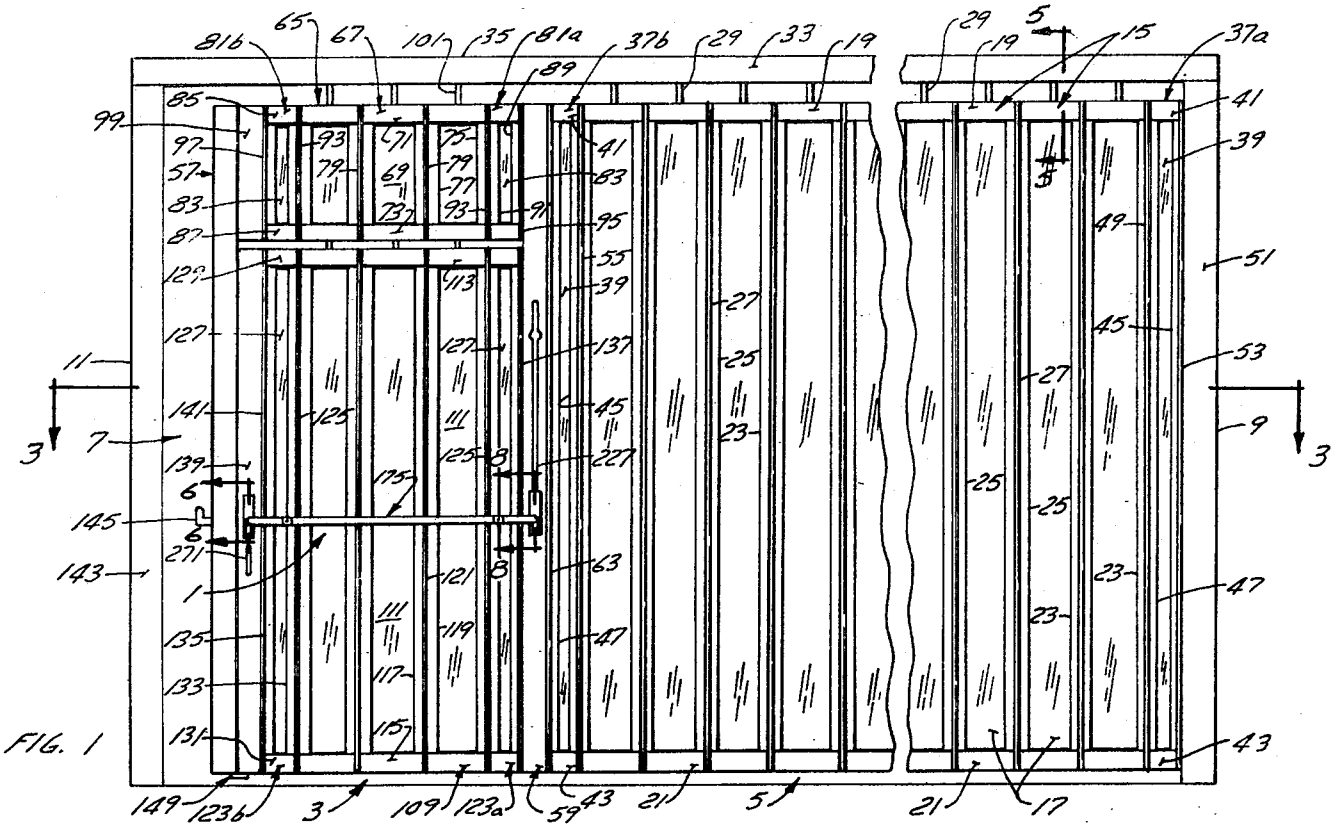
FIG. 1 is an elevation view of a portion of a folding closure, in the unfolded position, having an emergency door therein equipped with a panic bar assembly of the present invention.
Figure 3:
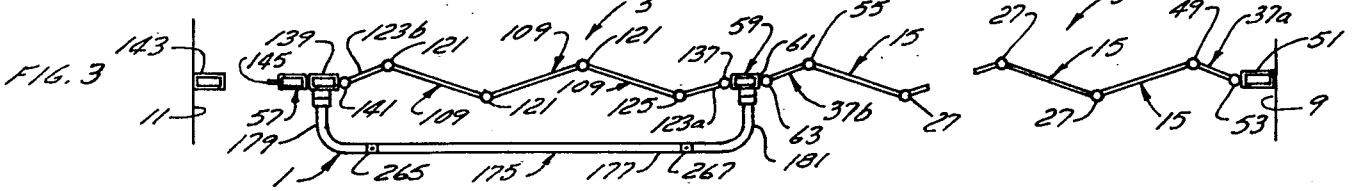
FIG. 3 is a cross-section view taken along line 3—3 of FIG. 1.
Figure 2:
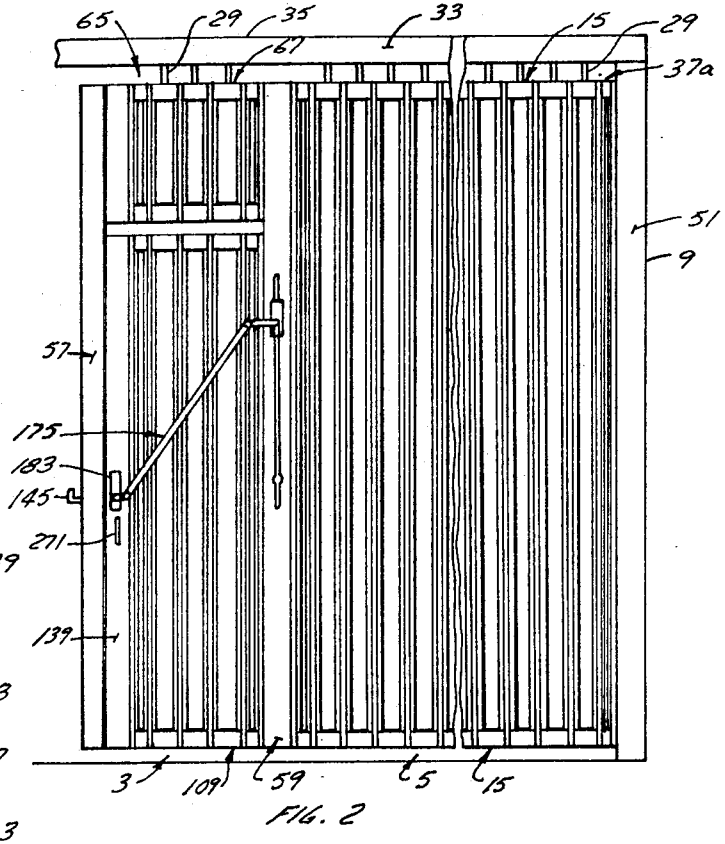
FIG. 2 is an elevation view showing the folding closure partly folded up.

The panic bar assembly 1 of the present invention is adapted for use in a folding door 3. The folding door 3 preferably is of the type forming part of a folding closure 5 as shown in FIGS. 1, 2 and 3. The folding closure 5 is used to close a wide entrance 7. The closure 5 is adapted to fold up within a small space at one side of the entrance when the entrance is to be opened, and to unfold to extend across the entrance from the one side 9 of the entrance to the other side 11 when the entrance is to be closed as shown in FIG. 1.

Figure 4:
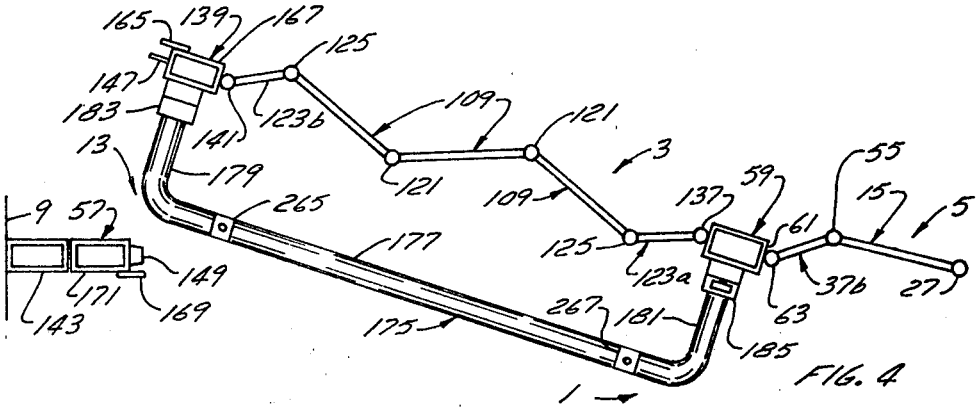
FIG. 4 is a partial cross-section view similar to FIG. 3 showing the folding door open.

The folding door 3 folds and unfolds with the folding and unfolding of the folding closure 5. When the folding closure 5 is unfolded and closes entrance 7, the folding door 3, in its unfolded position, can be swung open from the rest of the closure 5 to open an emergency exit 13 in the closure as shown in FIG. 4. In the embodiment shown, the door 3 is located at one end of the folding closure. The door can however be located at any position in the folding closure 5.

Figure 5:
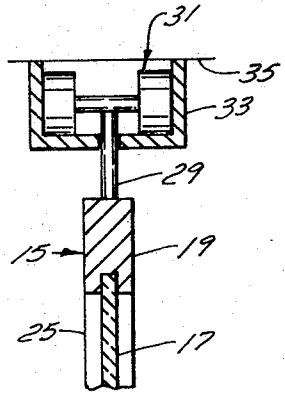
FIG. 5 is a partial cross-section view taken along line 5—5 of FIG. 1.

In more detail as shown in FIG. 1, the folding closure 5 can be of the type having a plurality of tall, narrow main panels 15. Each main panel 15 comprises a large, transparent pane 17 mounted between top and bottom frame members 19, 21 and between side frame members 23, 25. Pivot means 27 hingedly connect the adjacent side frame members 23, 25 of adjacent panels 15 together. The pivot means 27 can be of any well known type normally employed in folding closures. The pivot means 27 normally limit the extent to which the closure can unfold thereby preventing the panels 15 from becoming aligned and thus facilitating folding of closure. The pivot means 27 can, by way of example, be of the type disclosed in my co-pending U.S. patent application Ser. No. 917,154 now abandoned. Each top frame member 19 has an upwardly projecting, centrally located connecting pin 29 as shown in FIG. 5 which rotatably connects to a trolley 31 running in a track 33. The track 33 is fixed to the top 35 of the entrance 7.

The closure 5 includes a pair of end panels 37*a*, 37*b* as shown in FIG. 1 each of which is half the width of a main panel 15. Each end panel 37*a*, 37*b* also comprises a large transparent pane 39 mounted between top and bottom side frame members 41, 43 and between side frame members 45, 47. Pivot means 49 hingedly connect one end panel 37*a* along one side to the first of the main panels 15 along adjacent side frames 47, 23 respectively. The other side of the end panel 37*a* is hingedly connected to a post 51 along its other side frame 45 by pivot means 53. Post 51 is fixed to the side 9 of the entrance by suitable means (not shown). The other end panel 37*b* is hingedly connected by pivot means 55 to the last of the main panels 15 along adjacent side frames 45, 25 respectively.

The closure 5 as shown in FIGS. 1, 2 and 4 further includes a pair of door frame posts 57, 59. The posts 57, 59 are tubular, have a rectangular cross-section, and extend the height of the closure. Post 57 forms the free end or side of the closure. The other post 59 is hingedly connected along one narrow side 61 by pivot means 63 to the side frame member 47 of end panel 37*b*.

A top folding section 65 as shown in FIGS. 1 and 2 connects the door frame posts 57, 59 together. The top section 65 includes a set of main panels 67, each main panel comprising a relatively short, narrow transparent pane 69 mounted between top and bottom frame members 71, 73 and side frame members 75, 77. Pivot means 79 hingedly connect the main panels 67 together at adjacent side frame members. The top section includes a pair of end panels 81*a*, 81*b*, one at each end of the set of main panels 67. Each end panel 81*a*, 81*b* has a width equal to half the width of a main panel 67. Each end panel 81*a*, 81*b* comprises a relatively short, narrow transparent pane 83 mounted between top and bottom frame members 85, 87 and side frame members 89, 91. Pivot means 93 hingedly connect one side of the end panels 81*a*, 81*b* to the main panels 67. Pivot means 95 hingedly connects the other side of end panel 81*a* to the post 59. Pivot means 97 hingedly connects the other side of end panel 81*b* to a short post member 99. This post member 99 is tubular, of rectangular cross-section and has a length equal to the length of the main panels 67 in the top section 65. The post member 99 has a narrow side abutting a narrow side of post member 57 and is fixed thereto by suitable means (not shown). A connecting pin 101 extends up from the center of each top frame member 71 of the main panels 67. Each pin 101 rotatably connects with a trolley running on track 31. The closure 5 is suspended from the track 31 by pins 29 and 101.

The door frame posts 57, 59 and the top folding section 65 of the closure define the rectangular emergency exit 13 in the closure beneath the top section 65 which exit is closed by the folding door 3 as shown in FIG. 1. The folding door 3 includes a set of main panels 109, equal in number and width to the number and width of the main panels 67 in the top section 65. The door main panels 109 have a length nearly equal to the height of the emergency exit 13 and each comprises a relatively long, narrow transparent pane 111 mounted between top and bottom frame members 113, 115 and side frame members 117, 119. Pivot means 121 hingedly connect the main panels 109 together at adjacent side frame members. A pair of end panels 123*a*, 123*b* are included in the door, each having a width equal to hold the width of the main panels 109. The end panels 123*a*, 123*b* are attached along their sides to the sides of the set of main panels 109 by pivot means 125. Each end panel comprises a transparent pane 127 mounted between top and bottom frame members 129, 131 and side frame members 133, 135. End panel 123*a* is hingedly attached along its other side frame 135 to post 59 by pivot means 137. End panel 123*b* is hingedly attached along its other side frame 133 to a tubular post 139 by pivot means 141. Post 139 has the same cross-sectional shape as post 99 in the top section 65.

In the structure described, all the various pivot means are of the same construction, differing only in length. Similarly, all the top and bottom frame members in the main panels 15, 67, and 109 are of the same construction as are the top and bottom frame members in the end panels 37*a*, 37*b*; 81*a*, 81*b*; and 123*a*, 123*b*. The side frame members in all the panels are of the same construction differing only in length.

While one form of folding closure structure has been described, other types of structures can be employed as well. For example, the main panels 15 of the folding closure 5 can be replaced with an arrangement of rods and short solid panels arranged in a checkboard pattern on the rods, the panels pivotably mounted on the rods, and the rods suspended from the track, on trolleys.

Figure 7:
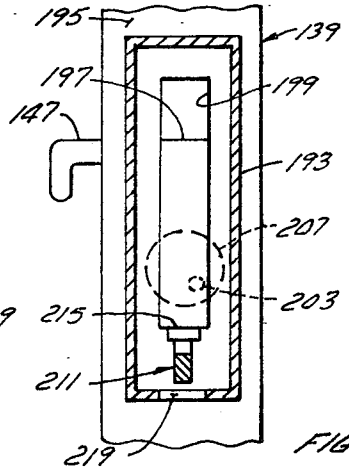
FIG. 7 is a cross-section view taken along line 7—7 of FIG. 6.

When the closure 5 is completely unfolded across the entrance 7, the end post 57 abuts a post 143 fixed to the side 11 of the entrance. A latch 145 as shown in FIGS. 1 and 3 is provided an closure 5, mounted within end post 57 and preferably opening upwardly, to hook into latching means (not shown) on fixed post 143 to close the closure across the entrance. A lock (not shown) can also be provided in end post 57 to lock the closure in its closed position. A latch 147 as shown in FIGS. 4 and 7, preferably opening downwardly, is mounted in door post 139 to cooperate with latch receiving means (not shown) in end post 57 to keep the door 3 closed within the emergency exit 13 in closure 5. The latch 147 is operated by the panic bar assembly 1 as will be described, to open door 3.

Figure 11:
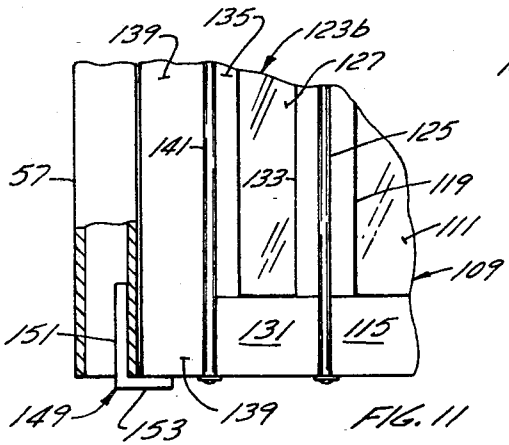
FIG. 11 is a detail view, in partial section, of the bottom of the folding door.

The door 3, in its closed position, preferably rests on a stop 149. The stop 149 comprises an angle member having one leg 151 fastened at the bottom of end post 57 as shown in FIG. 11 by suitable means (not shown). The other leg 153 of the stop projects from end post 57 into the emergency exit 13 to support the bottom end of door post 139 thereon when the door is closed.

Figure 10:
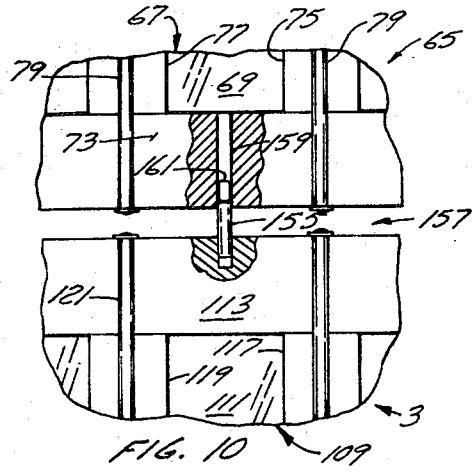
FIG. 10 is a detail view, in partial section, of the top of the folding door.

Preferably, means are provided for maintaining the folding door 3 and the top section 65 of the closure aligned when the closure 5 is unfolded. These aligning means can comprise a guide pin 155 mounted in the center of each upper frame member 113 in the main panels 109 of the door 3. Each guide pin 155 projects up from the frame member 113 to span the gap 157 between the top of the door and the bottom of the top section 65 and to just enter into a bore 159 extending up the center of each bottom frame member 73 in the main panels 67 of the top door section 65 as shown in FIG. 10. A screw 161 is threaded up into each bore 159 from the bottom edge of the frame member 73. The screw 161 is adjustable within the bore 159 and limits the entry of the guide pin 155 into the bore 159. The guide pins 155 normally just engage in the bores 159 to maintain the door main panels 199 and the top section main panels 67 aligned.

A stop member 165 preferably is provided on the outside surface 167 of door post 139 as shown in FIG. 4. The stop member 165 projects from post 139 to interfere with door frame post 57 and thus limit movement of the door 3 when it is being closed. Stop member 165 prevents the door 3 from moving back through the opening 13 when closing 85, and aligns posts 57, 139 so the latch 147 can close properly. If desired, a second stop member 169 as shown in FIG. 4 can be mounted on the inside surface 171 of post 57 to interfere with door post 139. Stop member 169 operates in the same manner as stop member 165.

In accordance with the present invention, a panic bar assembly 1 is provided for the folding door 3 so that it can be easily opened from the inside in case of an emergency. The panic bar assembly 1 is mounted on the posts 59, 139 and normally extends generally horizontally across the door between the posts 59, 139 at about waist level when the door 3 is in its unfolded position. The panic bar assembly 1 includes a panic bar 175 having a relatively long handle 177 and a short arm 179, 181 at each end of the handle 177. The handle 177 and arms 179, 181 merge smoothly to form a panic bar 175 having a shallow U-shape as shown in FIGS. 3 and 4. The free ends of the arms 179, 181 are mounted in mounting members 183, 185 respectively. Mounting member 183 is mounted on door frame post 139 and mounting member 185 is mounted on door post 59.

Figure 6:
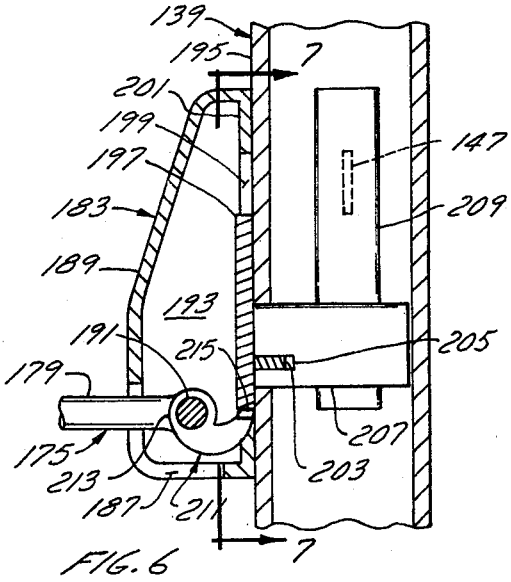
FIG. 6 is a partial cross-section view taken along line 6—6 of FIG. 1.

In more detail, arm 179 of the panic bar 175 extends through a slot 187 in the front wall 189 of the mounting member 183 as shown in FIG. 6. The end of the arm 179 is fixedly mounted on a transverse pin 191 which in turn is rotatably mounted in the side wall 193 of member 183. The mounting member 183 is itself fixedly mounted on the inside wall 195 of the door frame post 139 by suitable means (not shown). Means are provided to operatively connect the panic bar 175 with the latch 147 mounted in the door frame post 139. These means include a sliding block 197 mounted within a slot 199 formed in the rear wall 201 of the mounting member 183 as shown in FIGS. 6 and 7. The block 197 has a pin 203 projecting therefrom. The pin 203 is loosely mounted in an off-center hole 205 provided in a cylinder 207. The cylinder 207 is rotatably mounted in, and forms part of, a standard lock (not shown) which is in the wall 195 of the door post 139. The standard lock is a commercially available item such as lock Model MS 1850A sold by Adams Manufacturing Co. Cylinder 207, operatively connects with the latch 147 via a locking link 209 mounted within the lock. The cylinder 207 can comprise the cylinder of known cylinder locks, with its length cut to fit within the lock. The cylinder 207 is rotatably mounted in the lock rather than fixedly as is customary with known cylinder locks. The locking link 209 is again of known construction from known cylinder locks as is its operative connection to cylinder 207 and latch 147. A curved operating link 211 is fixedly attached at one end 213 to the pin 191. The other end 215 of the link 211 is operatively connected to the bottom end of the sliding block 197.

Figure 8:
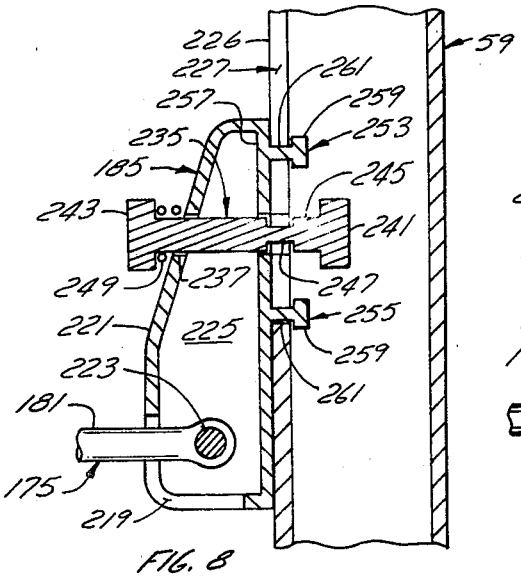
FIG. 8 is a cross-section view taken along line 8—8 of FIG. 1.
Figure 9:
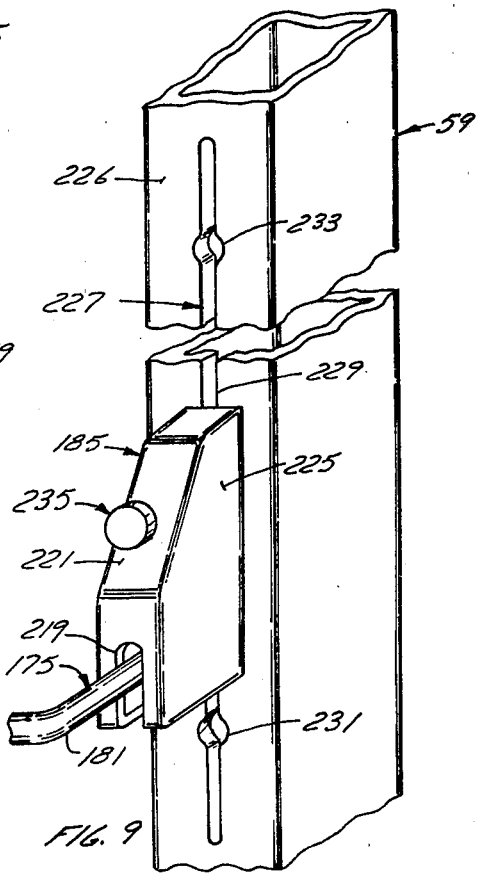
FIG. 9 is a detail perspective view of one end of the panic bar.

The other arm 181 of panic bar 175 extends through a slot 219 in the front wall 221 of mounting member 185 as shown in FIGS. 8 and 9. The end of the arm 181 is rotatably mounted on a pin 223 which is mounted between the side walls 225 of the mounting member 185. The pins 191, 223 are normally aligned. When the handle 177 of the panic link 175 is swung down and toward the door 3, about pins 191, 223 the link 211 slides block 197 up to rotate cylinder 207 and to thus unlock the latch 147 via movement of link 209 allowing the door 3 to open.

In accordance with the present invention, the mounting member 185 is slidably mounted on the post 59. To this end, the inside wall 226 of the post 59 has a slot 227 therein extending up for some distance from waist level as shown in FIGS. 8 and 9. The slot 227 has a narrow main section 229 with an enlarged portion 231, 233 near each end of the main section 229. A guide pin 235 slidably connects the mounting member 185 to the post 59. The guide pin 235 projects through a hole 237 in the front wall 221 of the mounting member, and through the slot 227 into post 59. The guide pin 235 has an enlarged head 241 at one end within the post 59, and an enlarged head 243 at the other end outside the mounting member 185. One or both of the heads 241, 243 can be threadedly mounted on the pin 235. The pin 235 has a first guide surface 245 adjacent inner head 241 sized to have the pin fit snugly in the enlarged areas 231, 233 of the slot 227. A second guide surface 247, adjacent the first guide surface 245, is sized to have the pin fit snugly in the narrow central portion 229 of the slot 227. A spring 249 is mounted about the pin 235 between its outer head 243 and the front wall 221 of the support member 185. The spring 249 normally tends to bias the inner head 241 against the wall 226 of post 59.

The mounting member 185 can be slidably retained against the post 59 by a pair of guide pins 253, 255 projecting from the back wall 257 of the member 185 through slot 227 into post 59 as shown in FIG. 8. Each guide pin 253, 255 has an enlarged head 259 and a stem 261 sized to pass through the narrow main section 229 of slot 227. The guide pins are threaded into the back wall 257 of mounting member 185, one on either side of pin 235. Other types of retaining means can be employed.

With the panic bar 175 in an operative horizontal position, the selectively movable mounting member 185 is mounted on post 59 to be level with the fixed mounting member 183. The large guide surface 245 of pin 235 is located within the lower enlarged portion 231 of slot 227 to lock the member in its lower position. To raise the mounting member 185 along face 226 of post 59, pin 235 is pushed in against spring 249 to align the small guide surface 247 with slot 227 as shown in FIG. 8. The unit can then be moved up the narrow portion 229 of slot to the upper enlarged slot portion 233 where pin 235 is moved outwardly to lock the member 185 in its raised position.

In order for the mounting member 185 to be able to slide up and down post 59 the panic bar 175 is provided with a pair of pivot means 265, 267 as shown in FIG. 4.

The pivot means preferably comprise universal joints. One universal joint 265 is located adjacent arm 179 in handle 177 and the other universal joint 267 is located adjacent the arm 181 in handle 177.

The universal joints 265, 267 permit the panic bar 175 to move to a diagonal position as the folding closure, including the folding door 3, is folded about pivot means 27, 79, 121 to be stored along the one side 9 of the entrance 7 as shown in FIG. 2. In moving to a diagonal position, the bar 175 avoids interfering with the folding of the closure. When the closure 5 is to be folded, the pin 235 in the mounting member 185 is pushed in to align the smaller guide section 247 on the pin with the narrow portion of the slot 227. Now as the closure, including the door, is folded, the mounting member 185 is simultaneously moved up in the slot 227 as the longitudinal distance between posts 57, 59 is reduced. The universal joints 265, 267 permit this upward movement of the one end of the panic bar relative to its other end to position the bar at a diagonal once the door is completely folded up. When the closure is opened up or unfolded across the opening, the panic bar 175 moves back to a horizontal position, with mounting member 185 simultaneously sliding down post 59 until pin 235 locks into the lower enlarged portion of slot 227. In this position, the panic bar 175 is ready to act in a normal manner to open the door 3 in an emergency.

The door 3 can be provided with a handle 271 on post 139 just beneath the panic bar 175. The handle 271 can be used to assist in rearming the panic bar 175 after it has been actuated. The handle 271 helps to steady the door 3 while bar 175 is being reset.

While the pair of pivot means in the panic bar 175 preferably comprise a pair of universal joints, other types of pivot means, pivotably about a single axis only, could be employed as well. The universal joints are preferred since they allow the folding closure to fold around a corner.

I claim:

1. A panic bar assembly for use in a folding door: the assembly having first and second mounting members adapted to be mounted at the sides of a folding door, at least one of the mounting members mounted for movement in a vertical direction on the door; a panic bar mounted at its ends to the mounting members; and a pair of spaced-apart pivot means in the panic bar allowing the panic bar to move as a result of movement of the one mounting member when the mounting member is moved in a vertical direction on the door.

2. A panic bar assembly as claimed in claim 1 wherein the panic bar comprises a shallow U-shaped member having a long handle portion and a short arm portion extending from each end of the handle portion, one pivot means in the handle portion adjacent one arm position and the other pivot means in the handle portion adjacent the other arm portion.

3. A panic bar assembly as claimed in claim 2 wherein the pivot means comprise universal joints.

4. A panic bar assembly as claimed in claim 1 including means on the one mounting member for locking it in one of two vertically spaced-apart positions on the door.

5. In combination; a folding door, a panic bar assembly for use with the folding door, the panic bar assembly having first and second mounting members mounted at the sides of the door, at least one of the mounting members mounted for movement in a vertical direction on the door, a panic bar mounted at its ends to the mounting members, and a pair of spaced-apart pivot means in the panic bar allowing the panic bar to move with the one mounting member when the mounting member is moved in a vertical direction on the door simultaneously with folding or unfolding of the door.

6. The combination of claim 5 wherein the door mounting member is fixed to the door, the one mounting member movable between a first position where it is generally horizontal with the other mounting member, and a second position vertically spaced from the first position.

7. The combination of claim 6 including means to selectively lock the one member in the first or second position.

8. The combination of claim 6 including a latch in the door, and means operatively connecting the panic bar assembly to the latch through the other fixed, mounting member.

9. The combination of claim 8 wherein the connecting means comprise a locking cylinder rotatably mounted in the side of the door and operatively connected to the latch, a sliding block mounted within the other mounting member, an eccentric pin loosely connecting the block to the cylinder, and a link operated by the panic bar to slide the block to rotate the cylinder to operate the latch.

10. The combination of claim 5 wherein the panic bar comprises a shallow U-shaped member having a long handle portion and a short arm portion extending from each end of the handle portion, the pivot means comprising a first universal joint in the handle portion adjacent one arm portion and a second universal joint in the handle portion adjacent the other arm portion.

* * * * *